US007543915B2

(12) United States Patent
Shaarawi et al.

(10) Patent No.: US 7,543,915 B2
(45) Date of Patent: Jun. 9, 2009

(54) FLUID EJECTION DEVICE

(75) Inventors: Mohammed S. Shaarawi, Corvallis, OR (US); Benjamin L. Clark, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/906,039

(22) Filed: Sep. 29, 2007

(65) Prior Publication Data

US 2008/0024559 A1 Jan. 31, 2008

Related U.S. Application Data

(62) Division of application No. 10/834,777, filed on Apr. 29, 2004, now Pat. No. 7,293,359.

(51) Int. Cl.
*B41J 2/05* (2006.01)

(52) U.S. Cl. ..... 347/56; 347/63; 347/64

(58) Field of Classification Search ..... 347/20, 347/44, 47, 56, 61–65, 67
See application file for complete search history.

(56) References Cited

U.S. PATENT DOCUMENTS

| | | | | |
|---|---|---|---|---|
| 4,229,265 | A | 10/1980 | Kenworthy | |
| 4,246,076 | A | 1/1981 | Gardner | |
| 4,296,421 | A | 10/1981 | Hara et al. | |
| 4,374,707 | A | 2/1983 | Pollack | |
| 4,412,224 | A | 10/1983 | Sugitani | |
| 4,438,191 | A | 3/1984 | Cloutier et al. | |
| 4,455,561 | A | 6/1984 | Boyden et al. | |
| 4,528,577 | A * | 7/1985 | Cloutier et al. | 347/47 |
| 4,532,530 | A | 7/1985 | Hawkins | |
| 4,716,423 | A * | 12/1987 | Chan et al. | 347/65 |
| 4,789,425 | A | 12/1988 | Drake et al. | |
| 4,984,664 | A | 1/1991 | Sugano | |
| 5,016,024 | A | 5/1991 | Lam et al. | |
| 5,122,812 | A | 6/1992 | Hess et al. | |
| 5,159,353 | A | 10/1992 | Fasen et al. | |
| 5,167,776 | A | 12/1992 | Bhaskar et al. | |
| 5,211,806 | A | 5/1993 | Wong et al. | |
| 5,236,572 | A | 8/1993 | Lam et al. | |
| 5,322,594 | A | 6/1994 | Bol | |
| 5,635,968 | A | 6/1997 | Bhaskar et al. | |
| 5,796,416 | A | 8/1998 | Silverbrook | |
| 6,007,188 | A | 12/1999 | MacLeod et al. | |
| 6,045,215 | A | 4/2000 | Coulman | |
| 6,113,216 | A | 9/2000 | Wong | |

(Continued)

OTHER PUBLICATIONS

Aden, J. Stephen et al., The Third-Generation HP Thermal InkJet Printhead, Hewlett-Packard Journal, Feb. 1994, pp. 41-45.

(Continued)

*Primary Examiner*—Juanita D Stephens

(57) ABSTRACT

A method for manufacturing a fluid ejection device includes providing a sacrificial structure substantially overlying a semiconductor substrate. The structure has a shape configured to define an ink chamber, ink manifold, and a nozzle. The method also includes providing a first metal adjacent the sacrificial structure and substantially overlying the substrate and removing the sacrificial structure to form the ink chamber and the nozzle. The method further includes removing a portion of the first and second sacrificial materials to form the sacrificial structure.

9 Claims, 6 Drawing Sheets

U.S. PATENT DOCUMENTS 6,113,221 A 9/2000 Weber
6,123,413 A 9/2000 Agarwal et al.
6,126,269 A * 10/2000 Takemoto et al. ..... 347/47
6,155,676 A 12/2000 Etheridge, III et al.
6,161,923 A 12/2000 Pidwerbecki et al.
6,180,427 B1 1/2001 Silverbrook
6,227,654 B1 5/2001 Silverbrook
6,243,113 B1 6/2001 Silverbrook
6,244,691 B1 6/2001 Silverbrook
6,254,219 B1 7/2001 Agarwal et al.
6,267,471 B1 7/2001 Ramaswami et al.
6,273,544 B1 8/2001 Silverbrook
6,299,294 B1 10/2001 Regan
6,299,300 B1 10/2001 Silverbrook
6,305,788 B1 10/2001 Silverbrook
6,309,048 B1 10/2001 Silverbrook
6,310,639 B1 10/2001 Kawamura et al.
6,315,384 B1 11/2001 Ramaswami et al.
6,318,849 B1 11/2001 Silverbrook
6,322,201 B1 11/2001 Beatty et al.
6,328,405 B1 12/2001 Weber et al.
6,336,713 B1 1/2002 Regan et al.
6,357,865 B1 3/2002 Kubby
6,364,461 B2 4/2002 Silverbrook
6,365,058 B1 4/2002 Beatty et al.
6,371,596 B1 4/2002 Maze et al.
6,375,313 B1 4/2002 Adavikolanu et al.
6,390,603 B1 5/2002 Silverbrook
6,402,296 B1 6/2002 Cleland et al.
6,402,300 B1 6/2002 Silverbrook
6,416,167 B1 7/2002 Silverbrook
6,420,196 B1 7/2002 Silverbrook
6,423,241 B1 7/2002 Yoon et al.
6,425,651 B1 7/2002 Silverbrook
6,439,689 B1 8/2002 Silverbrook
6,439,699 B1 8/2002 Silverbrook
6,443,558 B1 9/2002 Silverbrook
6,451,216 B1 9/2002 Silverbrook
6,460,778 B1 10/2002 Silverbrook
6,460,971 B2 10/2002 Silverbrook
6,464,340 B2 10/2002 Silverbrook
6,475,402 B2 11/2002 Nordstrom et al.
6,481,831 B1 11/2002 Davis et al.
6,482,574 B1 11/2002 Ramaswami et al.
6,488,358 B2 12/2002 Silverbrook et al.
6,488,362 B2 12/2002 Silverbrook
6,489,084 B1 12/2002 Pidwerbecki et al.
6,491,833 B1 12/2002 Silverbrook
6,503,408 B2 1/2003 Silverbrook
6,505,912 B2 1/2003 Silverbrook et al.
6,508,546 B2 1/2003 Silverbrook
6,520,624 B1 2/2003 Horvath et al.
6,530,653 B2 3/2003 Le et al.
6,535,237 B1 3/2003 Wong
6,540,325 B2 4/2003 Kawamura et al.
6,543,880 B1 4/2003 Akhavain et al.
6,547,364 B2 4/2003 Silverbrook
6,547,371 B2 4/2003 Silverbrook
6,557,978 B2 5/2003 Silverbrook
6,561,625 B2 5/2003 Maeng et al.
6,588,882 B2 7/2003 Silverbrook
6,598,964 B2 7/2003 Silverbrook
6,623,108 B2 9/2003 Silverbrook
6,627,467 B2 9/2003 Haluzak et al.
6,634,735 B1 10/2003 Silverbrook
6,641,254 B1 11/2003 Boucher et al.
6,644,786 B1 11/2003 Lebens
6,644,793 B2 11/2003 Silverbrook
6,648,453 B2 11/2003 Silverbrook
6,652,074 B2 11/2003 Silverbrook
6,652,082 B2 11/2003 Silverbrook

OTHER PUBLICATIONS

Beeson, Rob, Thermal Inkjet: Meeting the Applications Challenge, printed from website http://www.hp.com/oeminkjet/reports/techpress-6.pdf on Jan. 7, 2004, 4 pages.

Lee, Jae-Duk et al., A Thermal Inkjet Printhead with a Monolithically Fabricated Nozzle Plate and Self-Aligned Ink Feed Hole, Journal of Microelectromechanical Systems, vol. 8, No. 3, Sep. 1999, pp. 229-236.

* cited by examiner

FLUID EJECTION DEVICE

This application is a divisional of the U.S. application Ser. No. 10/834,777, filed on Apr. 29, 2004, entitled "A Method For Manufacturing A Fluid Ejection Device", now U.S. Pat. No. 7,293,359, by Shaarawi et al., which is assigned to the assignee of the present invention and hereby incorporated by reference herein in its entirety.

BACKGROUND

Fluid ejection devices for use in fluid ejection assemblies, such as ink jet printers, utilize fluid ejection devices (e.g., ink cartridges) that include printheads that include an ink chamber and manifold and a plurality of nozzles or apertures through which ink is ejected from the printhead onto a print or recording medium such as paper. The microfluidic architecture used to form the chamber and nozzles may include a semiconductor substrate or wafer having a number of electrical components provided thereon (e.g., a resistor for heating ink in the chamber to form a bubble in the ink, which forces ink out through the nozzle).

The chamber, manifold, and nozzle may be formed from layers of polymeric materials. One difficulty with the use of polymeric materials to form the nozzle and chamber is that such materials may become damaged or degraded when used with particular inks (e.g., inks having relatively high solvent contents, etc.).

Another difficulty with the use of polymeric materials is that such materials may become damaged or degraded when subjected to certain temperatures that may be reached during operation of the printhead. For example, certain known polymers used to form the printhead may begin to degrade at temperatures between approximately 70° C. and 80° C. or higher.

DETAILED DESCRIPTION OF THE EXAMPLE EMBODIMENTS

According to an example embodiment, a method or process for producing or manufacturing a printhead (e.g., a thermal ink jet printhead) includes utilizing a sacrificial structure as a mold or mandrel for a metal or metal alloy that is deposited thereon, after which the sacrificial structure is removed. The sacrificial structure defines a chamber and manifold for storing ink and a nozzle in the form of an aperture or opening (e.g., an orifice) through which ink is ejected from the printhead. According to an example embodiment, the metal or metal alloy is formed using a metal deposition process, nonexclusive and nonlimiting examples of which include electrodeposition processes, electroless deposition processes, physical deposition processes (e.g., sputtering), and chemical vapor deposition processes.

One advantageous feature of utilizing metals to form the nozzle and chamber layers of the printhead is that such metals may be relatively resistant to inks (e.g., high solvent content inks) that may degrade or damage structures conventionally formed of polymeric materials and the like. Another advantageous feature is that such metal or metal alloy layers may be subjected to higher operating temperatures than can conventional printheads. For example, polymeric materials used in conventional printheads may begin to degrade at between 70° C. and 80° C. In contrast, metal components will maintain their integrity at much higher temperatures.

Figure 1:
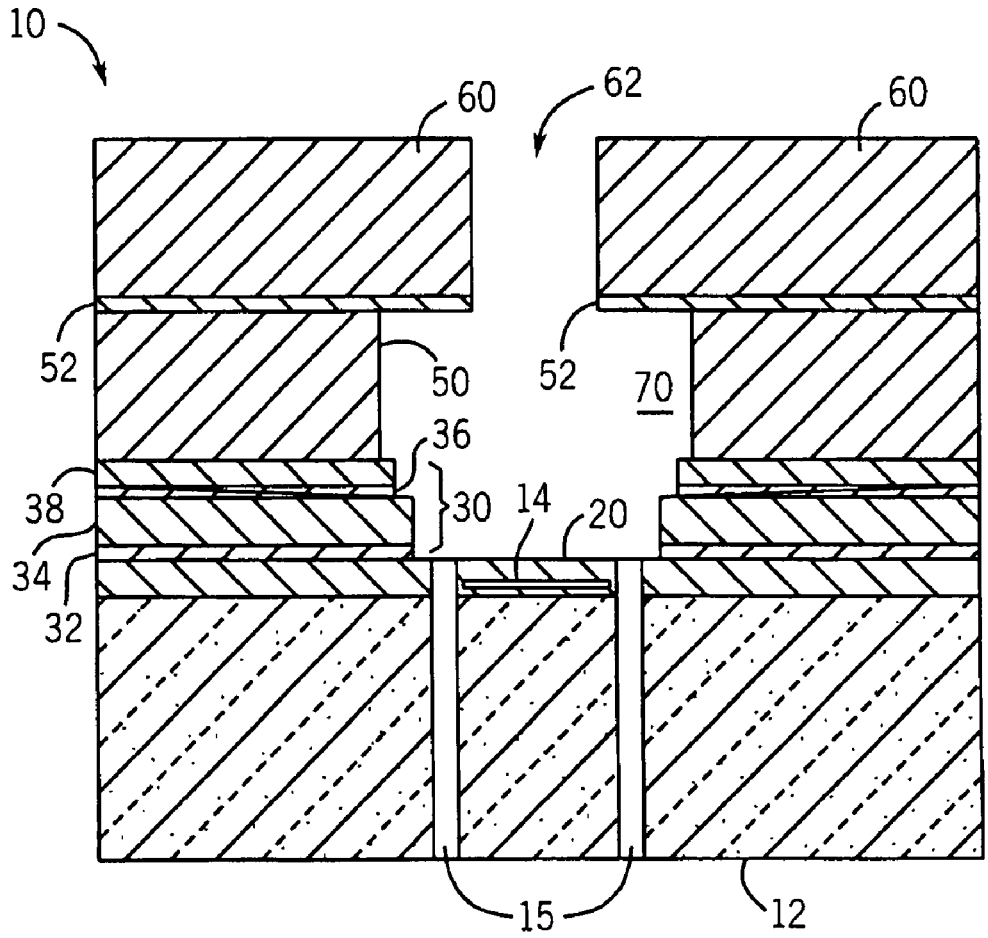
FIG. 1 is a schematic cross-sectional view of a portion of a printhead according to an example embodiment.

FIG. 1 is a schematic cross-sectional view of a portion of a thermal ink jet printhead 10 according to an example embodiment. Printhead 10 includes a chamber 70 that receives ink from ink feed channels 15. Ink is ejected from chamber 70 through an opening 62, which in one embodiment is a nozzle, onto a print or recording medium such as paper when printhead 10 is in use.

Printhead 10 includes a substratum 12 such as a semiconductor or silicon substratum. According to other embodiments, any of a variety of semiconductor materials may be used to form substratum 12. For example, a substrate may be made from any of a variety of semiconductor materials, including silicon, silicon-germanium, (or other germanium-containing materials), or the like. The substrate may also be formed of glass ($SiO_2$) according to other embodiments.

A member or element in the form of a resistor 14 is provided above substratum 12. Resistor 14 is configured to provide heat to ink contained within chamber 70 such that a portion of the ink vaporizes to form a bubble within chamber 70. As the bubble expands, a drop of ink is ejected from opening 62. Resistor 14 may be electrically connected to various components of printhead 10 such that resistor 14 receives input signals or the like to selectively instruct resistor 14 to provide heat to chamber 70 to heat ink contained therein.

According to an example embodiment, resistor 14 includes $WSi_xN_y$. According to various other example embodiments, the resistor may include any of a variety of materials, including, but not limited to TaAl, Ta $Si_xN_y$, and $TaAlO_x$.

A layer of material 20 (e.g., a protective layer) is provided substantially overlying resistor 14. Protective layer 20 is intended to protect resistor 14 from damage that may result from cavitation or other adverse effects due to any of a variety of conditions (e.g., corrosion from ink, etc.). According to an example embodiment, protective layer 20 includes tantalum or a tantalum alloy. According to other example embodiments, protective layer 20 may be formed of any of a variety of other materials, such as tungsten carbide (WC), tantalum carbide (TaC), and diamond like carbon.

A plurality of thin film layers 30 are provided substantially overlying protective layer 20. According to the example embodiment shown in FIG. 1, thin film layers 30 comprise four layers 32, 34, 36, and 38. According to other embodiments, a different number of layers (e.g., greater than four layers, etc.) may be provided. Layers 20, 32, 34, 36, and 38 (FIG. 1) may protect the substrate from inks used during operation of the printhead and/or act as adhesion layers or surface preparation layers for subsequently deposited material. According to other example embodiments, additional layers of material may be provided intermediate or between layer 20 and substratum 12. Such additional layers may be associated with logic and drive electronics and circuitry that are responsible for activating or firing resistor 14.

As shown in FIG. 1, layer 38 is a seed layer that may be used as a cathode during electrodeposition of overlying metal layers. According to an example embodiment, seed layer 38 comprises a metal such as gold or a gold alloy. According to other embodiments, the seed layer may comprise any of a variety of other metals or metal alloys such as nickel, nickel-chromium alloys, and copper. According to an example embodiment, seed layer 38 has a thickness of between 500 and 1,000 angstroms. According to other example embodiments, the thickness of seed layer 38 is between approximately 500 and 10,000 angstroms.

The various layers (e.g., layers 32, 34, 36, 38, and any additional layers provided intermediate layer 20 and substratum 12) can include conductors such as gold, copper, titanium, aluminum-copper alloys, and titanium nitride; tetraethylorthosilicate (TEOS) and borophosphosilicate glass (BPSG) layers provided for promoting adhesion between underlying layers and subsequently deposited layers and for insulating underlying metal layers from subsequently deposited metal layers; silicon carbide and $Si_xN_y$ for protecting circuitry in the printhead from corrosive inks; silicon dioxide, silicon, and/or polysilicon used for creating electronic devices such as transistors and the like; and any of a variety of other materials.

A layer 50 (hereinafter referred to as chamber layer 50) is provided substantially overlying thin film layers 30. According to an example embodiment, chamber layer 50 is formed of nickel or a nickel alloy. According to various other example embodiments, chamber layer 50 may comprise other metals or metal alloys such as one or more of gold (Au), gold-tin (AuSn) alloys, gold-copper (AuCu) alloys, nickel-tungsten (NiW) alloys, nickel-boron (NiB) alloys, nickel-phosphorous (NiP) alloys, nickel-cobalt (NiCo) alloys, nickel-chromium (NiCr) alloys, silver (Ag), silver-copper (AgCu) alloys, palladium (Pd), palladium-cobalt (PdCo) alloys, platinum (Pt), rhodium (Rh), and others. According to an example embodiment, the metal or metal alloy utilized for chamber layer 50 may be provided by an electroplating or electroless deposition process.

According to an example embodiment, chamber layer 50 has a thickness of between approximately 20 and 100 micrometers. According to other example embodiments, chamber layer 50 has a thickness of between approximately 5 and 50 micrometers.

A seed layer 52 is provided substantially overlying chamber layer 50 according to an example embodiment. Seed layer 52 is adapted or configured to promote adhesion between an overlying nozzle layer 60 and chamber layer 50. According to an example embodiment, seed layer 52 comprises nickel or a nickel alloy. According to other embodiments, seed layer 52 may comprise any of the metals or metal alloys described above with respect to chamber layer 50. Seed layer 52 has a thickness of between approximately 500 and 1,000 angstroms according to one example embodiment, and a thickness of between approximately 500 and 3,600 angstroms (or greater than 3,600 angstroms) according to various other embodiments.

While seed layer 52 is shown in FIG. 1 as being formed as a single layer of material, according to other example embodiments, such a seed layer may include more than one layer of material. For example, the seed layer may be formed of a first layer comprising tantalum followed by a second layer comprising gold. According to such an embodiment, the tantalum may be utilized to promote adhesion of the gold layer to the underlying chamber layer (e.g., chamber layer 50).

Nozzle layer 60 is provided substantially overlying chamber layer 50 and seed layer 52. According to an example embodiment, nozzle layer 60 has a thickness of between approximately 5 and 100 micrometers. According to other example embodiments, nozzle layer 60 has a thickness of between approximately 5 and 30 micrometers.

Chamber layer 60 is patterned to define opening 62 (e.g., an aperture or hole is provided in nozzle layer 60 to define opening 62). According to an example embodiment, opening 62 is formed as a relatively cylindrical aperture through nozzle layer 60, and may have a diameter of between approximately 10 and 20 micrometers. According to other example embodiments, the diameter of opening 62 is between approximately 4 and 45 micrometers.

According to an example embodiment, nozzle layer 60 comprises the same material as is used to form chamber layer 50. According to other example embodiments, chamber layer 50 and nozzle layer 60 may be formed of different materials.

FIGS. 2A through 2G are schematic cross-sectional views of a portion of a thermal ink jet printhead similar to that shown in FIG. 1 showing the steps of a manufacturing process according to an example embodiment.

Figure 2A:
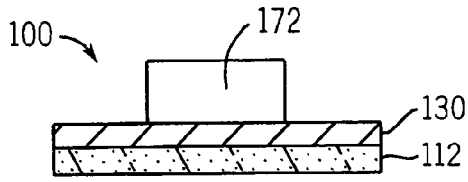
FIGS. 2A-2G are schematic cross-sectional views of a portion of a printhead similar to that shown in FIG. 1 showing the steps of a manufacturing process according to an example embodiment.

As shown in FIG. 2A, a thin film layer 130 is provided above a substratum 112. Thin film layer 130 may be similar to thin film layer 30 shown in FIG. 1, and may include a seed layer and any of a number of additional thin film layers such as those described with respect to FIG. 1. Thin film layer 130 is provided substantially overlying a resistor and protective layer (not shown) such as that shown in FIG. 1 as resistor 14 and protective layer 20, as are known in the art.

While thin film layer 130 is shown as a continuous layer, a portion of thin film layer 130 may be removed above the resistor, as shown in the example embodiment shown in FIG. 1. Removal of a portion of thin film layer 130 may occur either before or after the processing steps shown in FIGS. 2A-2G. For example, where such a portion is removed before the processing steps described in FIGS. 2A-2G, photoresist material may fill the removed portion during processing prior to its subsequent removal to form a chamber and nozzle such as chamber 70 and opening 62 such as those shown in FIG. 1. It should also be noted that the removal of a portion of similar thin film layers 230 and 330 may be performed before or after the process steps shown and described with respect to FIGS. 3A-3E and 4F-4D, respectively. For simplicity, each of the embodiments shown and FIGS. 2A-2G, 3A-3E and 4A-4D will be described as if removal of a portion of the film layers 130, 230 and 330 occurs after the formation of the chamber and nozzle.

As shown in FIG. 2A, a sacrificial material is provided substantially overlying thin film layer 130 and patterned to form a sacrificial structure or pattern 172. Sacrificial structure 172 may comprise a photoresist material, such as a positive or negative photoresist material, and may be provided according to any suitable means (e.g., lamination, spinning, etc.). According to one example embodiment, the sacrificial material used to form sacrificial structure 172 is a positive photoresist material such as SPR 220, commercially available from Rohm and Haas of Philadelphia, Pa. According to another example embodiment, the sacrificial material is a negative photoresist material such as a THB 151N material commercially available from JSR Micro of Sunnyvale, Calif. or an SU8 photoresist material available from MicroChem Corporation of Newton, Mass.

According to other example embodiments, other sacrificial materials may be used for the sacrificial material, such as tetraethylorthosilicate (TEOS), spin-on-glass, and polysilicon. One advantageous feature of utilizing a photoresist material is that such material may be relatively easily patterned to form a desired shape. For example, according to an example process, a layer of photoresist material may be deposited or provided substantially overlying thin film layer 130 and subsequently exposed to radiation (e.g., ultraviolet (UV) light) to alter (e.g., solubize or polymerize) a portion of the photoresist material. Subsequent removal of exposed or nonexposed portions of the photoresist material (e.g., depending on the type of photoresist material utilized) will result in a relatively precise pattern of material.

Figure 2B:
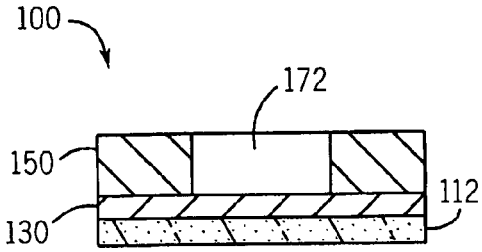

Subsequent to the formation or patterning of sacrificial structure 172, a layer 150 of metal is provided in FIG. 2B substantially overlying thin film layer 130 in areas not covered by sacrificial structure 172. In this manner, sacrificial structure 172 acts as a mandrel or mold around which metal may be deposited. Sacrificial structure 172 also acts to mask a portion of the underlying layers from having metal of layer 150 provided therein. While layer 150 is shown as being deposited such that its top surface is substantially planar with the top surface of sacrificial structure 172, layer 150 may be deposited to a level higher than the top surface of sacrificial structure 172 and polished or etched such that it is coplanar with the top surface of sacrificial structure 172.

According to an example embodiment, layer 150 is intended for use as a chamber layer such as chamber layer 50 shown in FIG. 1. Accordingly, layer 150 may be formed from any of a variety of metals and metal alloys such as those described above with respect to chamber layer 50. For example, according to one example embodiment, layer 150 comprises nickel or a nickel alloy. One method by which nickel may be provided for layer 150 (or for any other layer described herein which may include nickel) is the use of a Watts bath containing nickel sulphate, nickel chloride and boric acid in aqueous solution with organic additives (e.g., saccharine, aromatic sulphonic acids, sulfonamides, sulphonimides, etc.).

Layer 150 is deposited using an electrodeposition process according to an example embodiment. According to one example embodiment, layer 150 is deposited in a direct current (DC) electrodeposition process using Watts nickel chemistry. In such an embodiment, electrodeposition is conducted in a cup style plating apparatus. According to other embodiments, electrodeposition can be carried out in a bath style plating apparatus. The Watts nickel chemistry is composed of nickel metal, nickel sulfate, nickel chloride, boric acid and other additives that have a compositional range from 1 milligrams per liter to 200 grams per liter for each component.

According to the example embodiment, a resist pattern is first prepared on the wafer surface (which may include any of a variety of thin film layers such as layers 32, 34, 36, and 38 shown in FIG. 1), after which the wafer is prepared for deposition by dipping for 30 seconds in sulfuric acid. Other acids or cleaning techniques such as plasma etching or UV ozone cleaning may be utilized in other embodiments. The wafer is then placed in the plating apparatus and electrodeposition begins by setting the DC power source to plate at a current density of approximately 3 amperes per square decimeter (amps/$dm^2$). In other embodiments, electrodeposition can utilize a current density range of between approximately 0.1 to 10 amps/$dm^2$ depending on the plating chemistry used and the desired plating rates (higher current densities can result in higher plating rates). These conditions can be used for deposition of the chamber and nozzle layers described with respect to the embodiment shown in FIGS. 2A-2F and in either of the embodiments illustrated in FIGS. 3A-3E and FIGS. 4A-4D.

According to another example embodiment, layer 150 may be provided in an electroless deposition process or any other process by which metal may be deposited onto thin film layer 130 (e.g., physical vapor deposition techniques such as a sputter coating, chemical vapor deposition techniques, etc.).

Figure 2C:
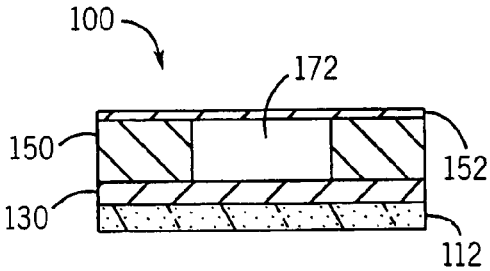

As shown in FIG. 2C, a layer of metal 152 (e.g., a seed layer) is provided substantially overlying both sacrificial structure 172 and layer 150. According to another example embodiment, layer 152 may be omitted. Layer 152 may be formed of similar materials as described with respect to layer 52 with regard to FIG. 1. Layer 152 may be deposited in any suitable process (e.g., physical vapor deposition, evaporation, electroless deposition, etc.). As described above with respect to layer 52, layer 152 may comprise a single layer of material or multiple layers of material (e.g., a first layer comprising tantalum and a second layer comprising gold, etc.).

Figure 2D:
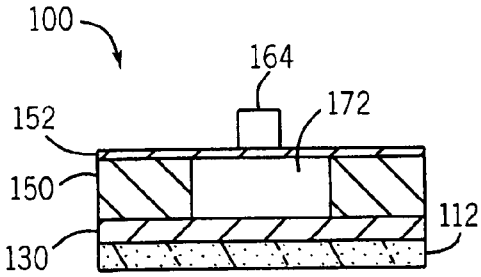

In FIG. 2D, a sacrificial structure 164 is provided substantially overlying layer 152 and aligned with sacrificial structure 172 using conventional photolithography masking and deposition methods. Sacrificial structure 164 may be formed of the same material as used to form sacrificial structure 172, or may differ therefrom. As with sacrificial structure 172, sacrificial structure 164 is formed by photolithographic methods from a layer of sacrificial material (e.g., positive or negative photoresist, etc.).

Figure 2E:
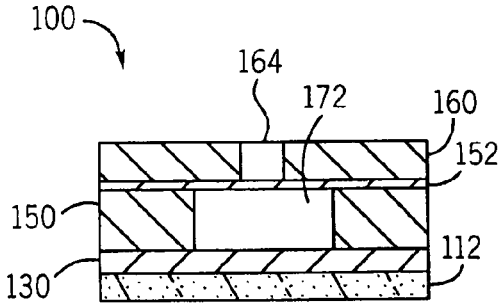

In FIG. 2E, a layer 160 of metal (similar to that provided as nozzle layer 60 in FIG. 1) is provided substantially overlying layer 152 in areas not covered by sacrificial structure 164. Layer 160 may be formed of a material similar to that used for nozzle layer 60 described with respect to FIG. 1.

Figure 2F:
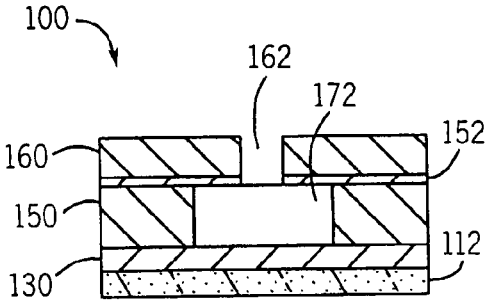
Figure 2G:
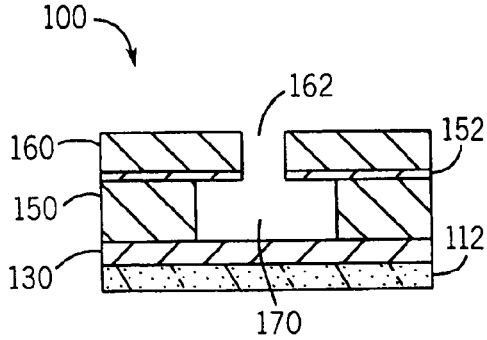

A chamber 170 and nozzle 162 are formed as shown in FIGS. 2F and 2G. As shown in FIG. 2F, sacrificial structure 164 is removed to form a nozzle 162. According to an example embodiment, sacrificial structure 164 is removed using any of a variety of methods. For example, sacrificial structure 164 may be removed with a solvent develop process, an oxygen plasma, an acid etch, or any of a variety of other processes suitable for removal of sacrificial structure 164.

As also shown in FIG. 2F, a portion of layer 152 underlying nozzle 162 is removed to expose an upper or top surface of sacrificial structure 172. Removal of the portion of layer 152 may be accomplished using a wet or dry etch or other process. According to an example embodiment in which layer 152 is formed of nickel or a nickel alloy, a dilute nitric acid etch may be utilized. According to another example embodiment in which gold or a gold alloy is used to form layer 152, a potassium iodide etch may be utilized. Any of a variety of etchants may be utilized that are suitable for removal of the portion of layer 152 (e.g., depending on the composition of layer 152, etc.). One consideration that may be utilized in choosing an appropriate etchant is the goal of avoiding damage to the metal utilized to form layers 150 and 160.

After the top or upper surface of sacrificial structure 172 is exposed (as shown in FIG. 2F), sacrificial structure 172 is removed as shown in FIG. 2G. Removal of sacrificial structure 172 may be accomplished using a similar method as described above with respect to sacrificial structure 164.

As shown in FIG. 2G, removal of sacrificial structures 164 and 172 and etching of a portion of layer 152 results in a structure including a chamber 170 for storage of ink for printhead 100 and a nozzle 162 for ejection of ink from chamber 170. While FIG. 2G shows chamber 170 provided substantially overlying thin film layers 130, all or a portion of thin film layers 130 underlying chamber 170 may be removed in a subsequent etching step. According to another example embodiment, thin film layers 130 may be etched prior to deposition of sacrificial structures 172 and 164. Other components of printhead 100 may also be formed prior to or after the formation steps described with respect to FIGS. 2A through 2G. For example, one or more ink feed channels 15 may be formed to provide ink to chamber 170 prior or subsequent to the formation of the structure shown in FIG. 2G.

FIGS. 3A to 3E are schematic cross-sectional views of a portion of a thermal ink jet printhead 200 similar to that shown in FIG. 1 showing the steps of a manufacturing process according to another example embodiment. In contrast to the example embodiment described with respect to FIGS. 2A to 2F, the example embodiment shown in FIGS. 3A to 3E utilizes a sacrificial structure that is formed prior to metal deposition used to form a chamber layer and a nozzle layer. In this embodiment, a metal layer such as a seed layer 152 (see, e.g., FIGS. 2A to 2F) is not required between a chamber layer and a nozzle layer.

Figure 3A:
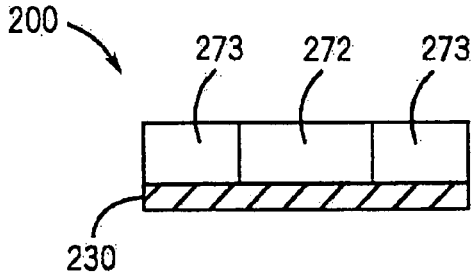
FIGS. 3A-3E are schematic cross-sectional views of a portion of a printhead similar to that shown in FIG. 1 showing the steps of a manufacturing process according to another example embodiment.
Figure 3B:
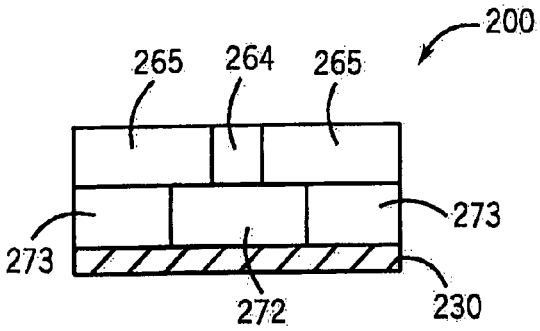

As shown in FIG. 3A, a first layer of sacrificial material is provided or formed substantially overlying a thin film layer 230 similar to that described above with respect to thin film layer 130. Once deposited, the first layer of sacrificial material will be patterned to define regions to be removed and regions to remain (i.e., that will be used to form a portion of a sacrificial structure). According to an example embodiment in which a negative photoresist material is provided substantially overlying thin film layer 230, the photoresist material is patterned by exposing the photoresist material to radiation such as ultraviolet light to form exposed portion 272 and unexposed portions 273. In this embodiment, exposed portions 272 polymerize in response to the exposure to ultraviolet light, and will act as a portion of a sacrificial structure to be used in the formation of a chamber and nozzle (see FIG. 3E). According to another embodiment, in which a positive photoresist is utilized, portion 272 may be unexposed and portions 273 may be exposed to ultraviolet light.

A second layer of sacrificial material is provided substantially overlying the first layer of sacrificial material and patterned to define at least one portion or region to be removed and to define a portion or region that will remain to form another portion of a sacrificial structure. Patterning may be accomplished in a manner similar to that described with reference to the first layer of sacrificial material, such as by exposing a portion of the second layer of sacrificial material to radiation such as ultraviolet light. In this manner, an exposed portion 264 and an unexposed portion 265 (or vice-versa where a positive photoresist material is utilized) is formed in the second layer of sacrificial material.

Figure 3C:
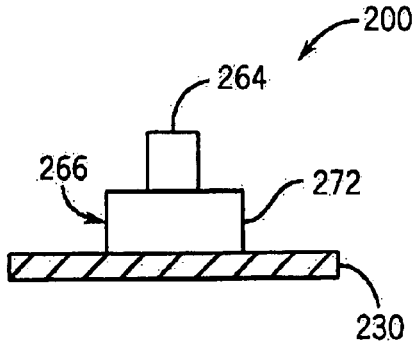

Subsequent to the exposure of portions of the first and second layers of sacrificial material, portions of each of the first and second layers are removed to form a sacrificial structure that may be used to define a chamber and nozzle for the printhead. In FIG. 3C, portions 273 and 265 are removed according to an example embodiment. The removal of portions of the photoresist results in the formation of a sacrificial structure 266 having a top or upper portion 264 to be used in the formation of a nozzle for printhead 200 and a bottom or lower portion 272 to be used in the formation of an ink chamber and ink manifold for printhead 200.

According to an example embodiment, the first and second layers of sacrificial materials used to form portions 264 and 272 are formed of the same material and are deposited in two separate deposition steps. In another example, the first and second layers of sacrificial materials are formed of a single layer of material formed in a single deposition step. In yet another example, the first and second layers of sacrificial materials used to form portions 264 and 272 are formed of different materials (e.g., a positive photoresist for one layer and a negative photoresist for the other layer).

Figure 3D:
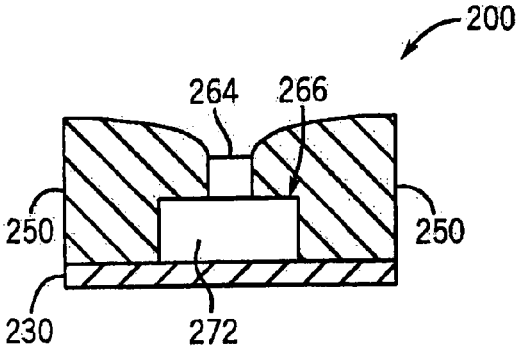

As shown in FIG. 3D, a layer 250 of metal is provided or deposited substantially overlying the thin film layer 230 and adjacent to portions 264 and 272 of sacrificial structure 266. According to an example embodiment, metal used to form layer 250 may be material similar to that described with respect to chamber layer 50 and nozzle layer 60 described with regard to FIG. 1. Metal used to form layer 250 may be provided using any acceptable deposition method, including electrodeposition, electroless deposition, physical vapor deposition, chemical vapor deposition, etc. According to an example embodiment in which the metal used to form layer 250 is deposited in a direct current electrodeposition (DC) process, the metal is provided such that it is level or slightly below the level of the top or upper surface of portion 264 of the sacrificial structure 266. As shown in FIG. 3D, the metal used to form layer 250 increases in thickness at distances away from portion 264. One reason for this is that as layer 250 thickens beyond the height of portion 272, the metal is deposited both vertically and laterally on top of portion 272, thus slowing the vertical deposition rate in the vicinity of portion 272. Once the lateral deposition of layer 250 stops, the deposition rate of layer 250 is the same everywhere (including substantially overlying portion 272 and adjacent portion 264).

Figure 3E:
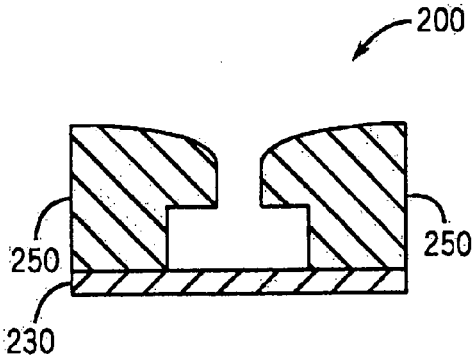

As shown in FIG. 3E, sacrificial structure 266 is removed after layer 250 is provided. Removal of sacrificial structure 266 may be accomplished using methods similar to those described above with respect to sacrificial structures 164 and 172. As described above with respect to FIGS. 2A through 2F, other processing steps may be utilized either prior or subsequent to the formation of the structure shown in FIG. 3E.

According to an example embodiment, the top or upper surface of metal layer 250 may be planarized using a chemical mechanical polish technique or other similar technique. One advantageous feature of performing such a planarization step is that the entire surface of printhead 200 will have a relatively flat or planar characteristic around the nozzle.

FIGS. 4A to 4D are schematic cross-sectional views of a portion of a printhead 300 similar to that shown in FIG. 1 showing the steps of a manufacturing process according to another example embodiment. Similar to the embodiment shown with respect to FIGS. 3A to 3E, one feature of the embodiment shown in FIGS. 4A to 4D is the formation of an entire sacrificial structure prior to the deposition of metal used to form a printhead structure.

Figure 4A:
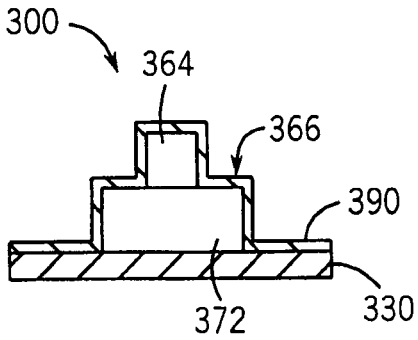
FIGS. 4A-4D are schematic cross-sectional views of a portion of a printhead similar to that shown in FIG. 1 showing the steps of a manufacturing process according to a further example embodiment.

As shown in FIG. 4A, a sacrificial structure 366 having a top or upper portion 364 and a bottom or lower portion 372 is formed substantially overlying a thin film layer 330. As with structures 264 and 272 described above with respect to FIGS. 3A to 3E, top portion 364 is utilized to form a nozzle and bottom portion 372 is utilized to form an ink chamber or ink manifold. The sacrificial structure 366 may be formed in a manner similar to that described above with respect to FIGS. 3A to 3E (i.e., utilizing the successive deposition, patterning and removal of a portion of two separate photoresist layers).

As also shown in FIG. 4A, a layer 390 of metal is provided substantially overlying the sacrificial structure 366 and the surface of thin film layers 330 not covered by sacrificial structure 366. Any of a variety of deposition methods may be used to form layer 390, including physical vapor deposition, evaporation, chemical vapor deposition, electrodeposition, electroless deposition, autocatalytic plating, etc. Layer 390 is intended to act as a seed layer for overlying metal layers used to form the printhead structure. According to an example embodiment, layer 390 may have a thickness of between approximately 500 and 3,000 angstroms. According to other example embodiments, layer 390 may have a thickness of between 500 angstroms and 2 micrometers.

Layer 390 may include a relatively inert metal such as gold, platinum and/or gold and platinum alloys. According to other embodiments, layer 390 may include palladium, ruthenium, tantalum, tantalum alloys, chromium and/or chromium alloys.

Figure 4B:
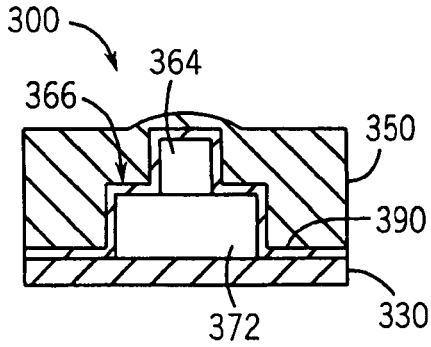

As shown in FIG. 4B, a layer 350 of metal is provided or deposited substantially overlying layer 390 (i.e., substantially overlying and around sacrificial structure 366 and substantially overlying portions of thin film layers 330 not covered by sacrificial structure 366). The material used to form layer 350 may be similar to that used to form chamber layer 50 and the nozzle layer 60 as shown in FIG. 1. As shown in FIG. 4B, a portion of the metal used to form layer 350 extends substantially overlying a top surface of a top portion 364 of sacrificial structure 366.

Figure 4C:
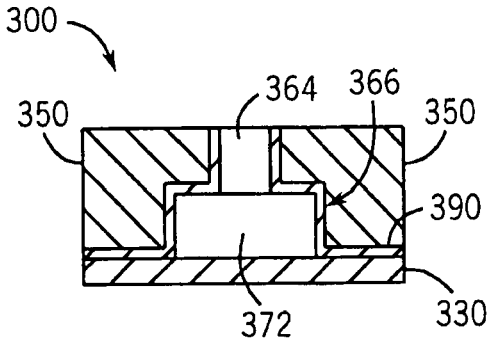

According to an example embodiment shown in FIG. 4C, a planarization process is used to planarize the top surface of layer 350 and sacrificial structure 366. According to an example embodiment, a chemical mechanical polish technique is utilized to planarize the top surface of layer 350 and sacrificial structure 366.

Figure 4D:
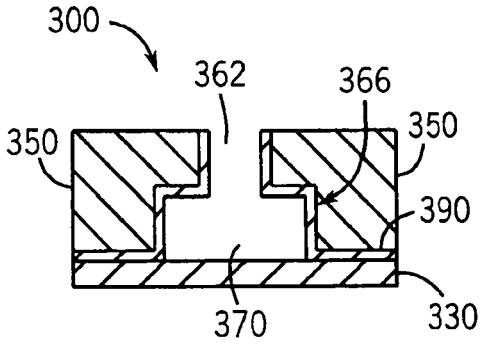

Sacrificial structure 366 is removed as shown in FIG. 4D using methods similar to those described above with respect to sacrificial structure 266. The result is the formation of a chamber 370 and a nozzle 362 similar to chamber 70 and opening 62 shown in FIG. 1. As described above, additional processing steps may be performed prior or subsequent to the formation of the structure shown in FIG. 4D.

As an optional step (not shown), a layer of metal similar or identical to that used to form layer 390 may be provided substantially overlying a top surface of layer 350. One advantageous feature of such a configuration is that layer 350 may be effectively encapsulated or clad to prevent damage from inks or other liquids. In this manner, relatively inert metals (e.g., gold, platinum, etc.) may be utilized to form the wall or surface that is in contact with ink used by the printhead, while a relatively less expensive material (e.g., nickel) may be used as a "filler" material to form the structure for the chamber and nozzle.

Figure 5:
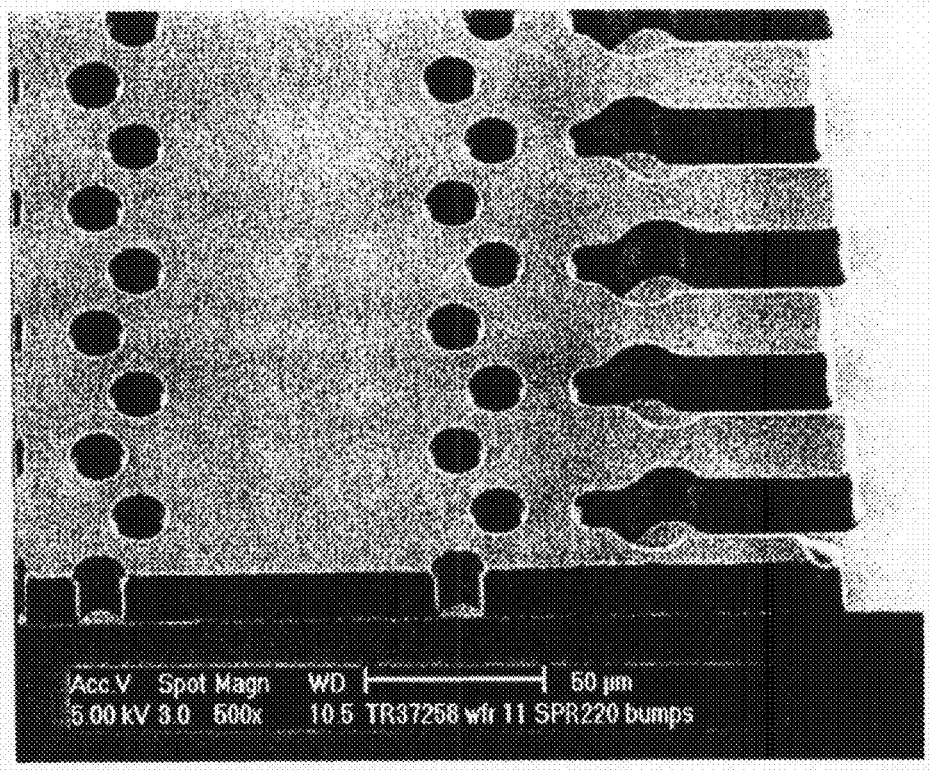
FIG. 5 is a scanning electron micrograph showing a sacrificial layer formed of a positive photoresist material according to an example embodiment.
Figure 6:
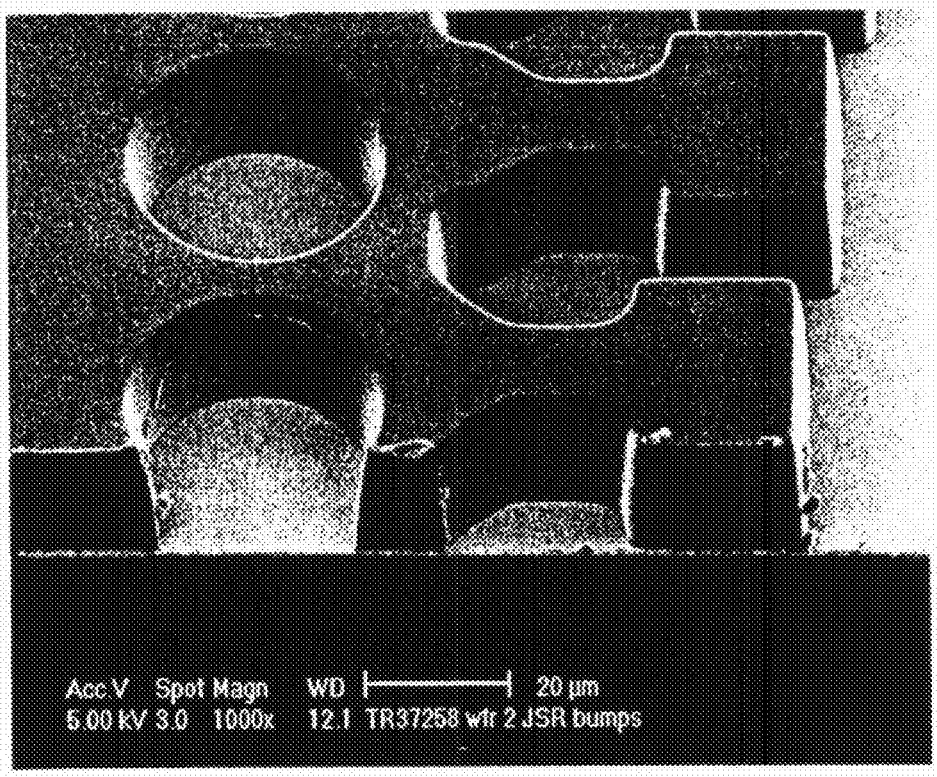
FIG. 6 is a scanning electron micrograph showing a sacrificial layer formed of a negative photoresist material according to an example embodiment.
Figure 7:
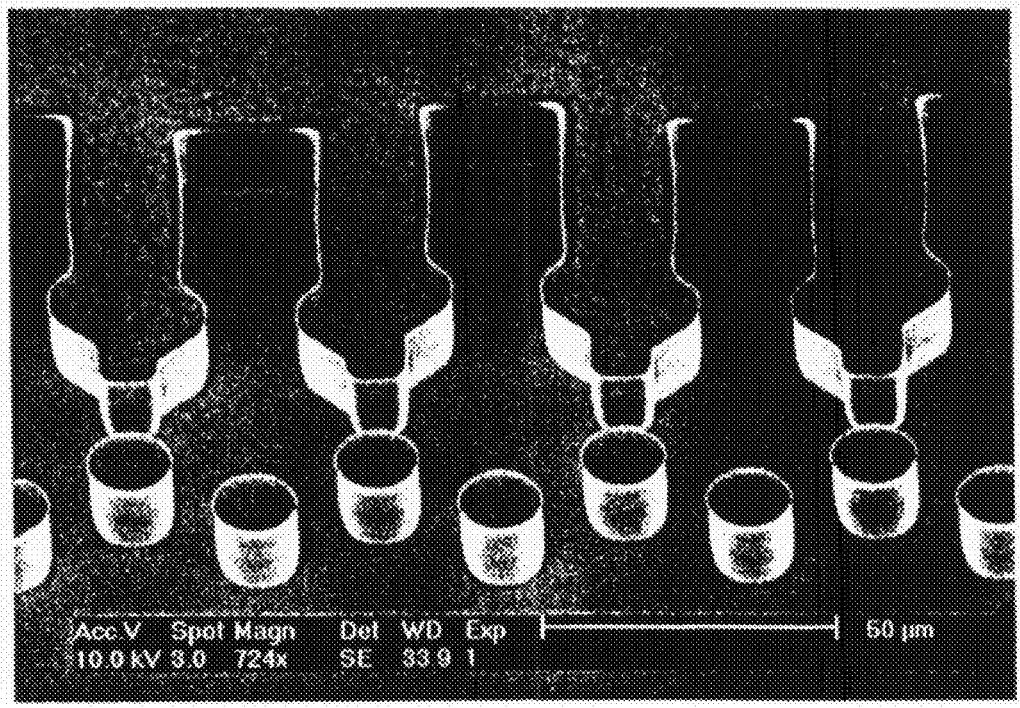
FIG. 7 is a scanning electron micrograph showing a number of inkjet printhead chambers subsequent to the removal of the positive photoresist material shown in FIG. 5.
Figure 8:
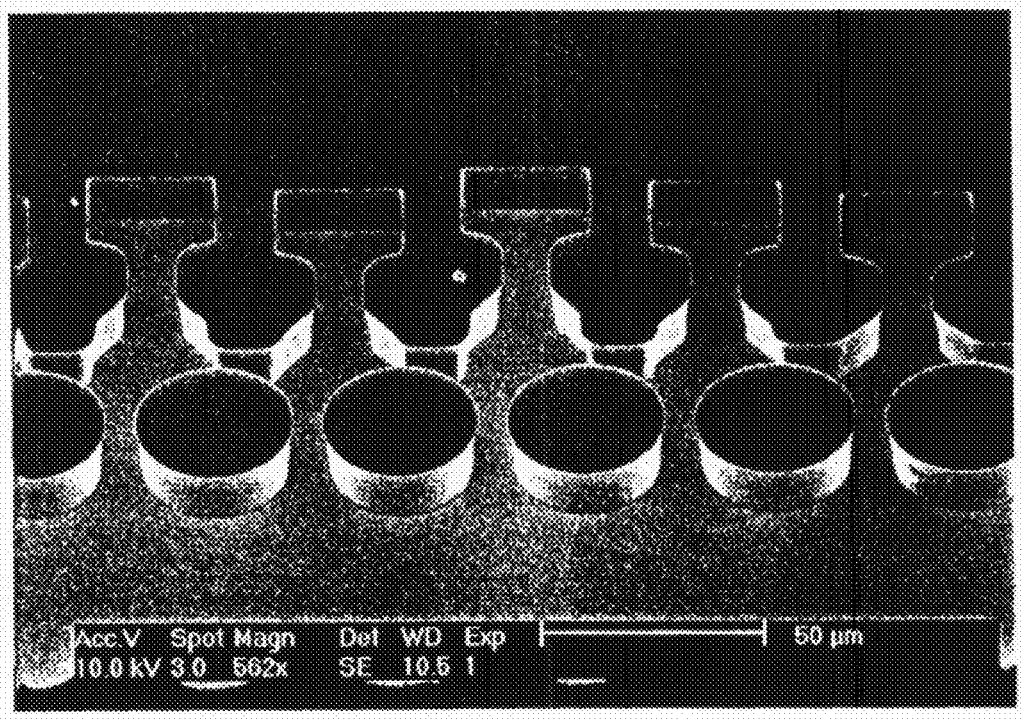
FIG. 8 is a scanning electron micrograph showing a number of ink jet printhead chambers subsequent to the removal of the negative photoresist material shown in FIG. 6.

FIGS. 5 to 8 are scanning electron micrographs illustrating the formation of ink jet printhead chambers according to example embodiments. FIG. 5 shows a chamber level sacrificial structure formed of a positive photoresist, magnified at 500 times. FIG. 6 shows a similar chamber level sacrificial structure formed from a negative photoresist material magnified at 1,000 times. FIGS. 7 and 8 show the formation of chambers subsequent to the removal of the sacrificial photoresist structures shown in FIGS. 5 and 6, respectively. FIG. 5 illustrates the initial shape of the resist mandrel created from the SPR220 resist. The shape of the walls of the plated material in FIG. 7 conform to the initial shape of the plating resist shown in FIG. 5. FIGS. 6 and 8 show that nickel plated around the JSR THB 151N resist also conforms well to the resist shape. FIGS. 7 and 8 also illustrate that it is possible to deposit structures that have a relatively flat or planar surface.

It should be noted that the construction and arrangement of the elements of the printhead and other structures as shown in the preferred and other example embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, orientations, etc.) without materially departing from the novel teachings and advantages of the subject matter recited herein. It should be noted that the elements and/or assemblies of the system may be constructed from any of a wide variety of materials that provide sufficient strength or durability. Other substitutions, modifications, changes and omissions may be made in the design, operating conditions and arrangement of the example embodiments without departing from the scope of the present inventions.

What is claimed is:

1. A fluid ejection device comprising:

a substrate formed of a semiconductor material;

a plurality of thin film layers overlying at least a portion of the substrate;

a chamber for storing ink overlying at least a portion of the plurality of thin film layers, the chamber being defined by a first layer of a metal;

a seed layer substantially overlying the chamber; and an orifice for ejecting ink from the chamber substantially overlying the seed layer and the chamber, the orifice being defined by a second layer of metal.

2. The fluid ejection device of claim 1, wherein the first layer of metal and the second layer of metal are formed of the same metal.

3. The fluid ejection device of claim 1, wherein the seed layer promotes adhesion between the first layer and the second layer of metal.

4. The fluid ejection device of claim 1, wherein the seed layer comprises at least one of a metal or a metal alloy.

5. A fluid ejection device comprising:

a substrate formed of a semiconductor material;

a plurality of thin film layers overlying at least a portion of the substrate;

a chamber for storing ink overlying at least a portion of the plurality of thin film layers, the chamber being defined by a first layer of a metal; and an orifice for ejecting ink from the chamber substantially overlying the chamber, the orifice being defined by a second layer of metal, wherein the first layer of metal and the second layer of metal are formed of different metals.

6. The fluid ejection device of claim 5, wherein one of the first layer of metal or the second layer of metal comprises at least one of nickel and a nickel alloy.

7. The fluid ejection device of claim 5 wherein one of the first layer of metal or the second layer of metal comprises at least one of gold, platinum, a gold alloy, and a platinum alloy.

8. The fluid ejection device of claim 5, wherein one of the first metal or the second metal comprises nickel and at least one of tungsten, boron, phosphorous, cobalt, and chromium.

9. The fluid ejection device of claim 5 wherein one of the first metal or the second metal comprises at least one of a gold-tin alloy, a gold-copper alloy, silver, a silver-copper alloy, palladium, a palladium-cobalt alloy, and rhodium.

* * * * *